United States Patent [19]

Levendusky

[11] 4,107,044

[45] Aug. 15, 1978

[54] METHOD OF AND APPARATUS FOR PURIFYING FLUIDS WITH RADIOACTIVE IMPURITIES

[75] Inventor: Jospeh A. Levendusky, Bayonne, N.J.

[73] Assignee: Epicor, Inc., Linden, N.J.

[21] Appl. No.: 717,583

[22] Filed: Aug. 25, 1976

[51] Int. Cl.[2] ..... G21F 9/04

[52] U.S. Cl. ..... 210/266; 210/38 C; 210/291; 252/301.1 W

[58] Field of Search ..... 210/27, 38 C, 289, 291, 210/266; 252/301.1 W; 423/6, 7

[56] References Cited

U.S. PATENT DOCUMENTS

| | | | |
|---|---|---|---|
| 2,643,772 | 6/1953 | Martin | 210/289 |
| 2,793,753 | 5/1957 | Webster | 210/38 C |
| 2,918,700 | 12/1959 | Hatch | 210/38 C |
| 3,685,657 | 8/1972 | Hunter et al. | 210/289 |
| 3,747,768 | 7/1973 | Barrera | 210/289 |
| 3,847,805 | 11/1974 | Voedisch | 210/291 |

*Primary Examiner*—Charles N. Hart
*Assistant Examiner*—Peter A. Hruskoci
*Attorney, Agent, or Firm*—Carella, Bain, Gilfillan & Rhodes

[57] ABSTRACT

Apparatus for removing dissolved and undissolved radioactive impurities from a fluid is disclosed. The apparatus includes a vessel having inlet and outlet structure and provision for filtration of undissolved solids and ion exchange removal of dissolved solids. The vessel is encased in a radiation impervious material and the method contemplates utilization of filtration materials and ion exchange materials substantially to exhaustion in disregard of radioactivity concentration thereafter to dispose of entire structure.

7 Claims, 5 Drawing Figures

METHOD OF AND APPARATUS FOR PURIFYING FLUIDS WITH RADIOACTIVE IMPURITIES

BACKGROUND OF THE INVENTION

This invention relates to apparatus for purifying fluids. More particularly, this invention relates to apparatus for removing dissolved and undissolved impurities from liquids such as water and the like, where such dissolved and undissolved impurities may be radioactive as occurs with respect to fluids such as water used in nuclear power plants.

Basically, the problems encountered in the purification of fluids such as water are exemplary of those present in the art of fluid purification. Fluids to be purified will generally contain two types of impurities, dissolved impurities and undissolved impurities.

One of the principal methods employed to remove undissolved solids from water, or other fluids, is to pass the fluid through a mechanical filter means, such as a filter screen, filter cloth, filter leaf or the like. With respect to the removal of dissolved impurities from water or other fluids, the use of ion exchange resins has become well known in the art. Such resins, which may be bead type or powdered type as is known in the art, when contacted by a fluid, release ions to the fluid while simultaneously capturing other free ions in the fluid. Accordingly, when a fluid is passed through a bed or beds of these ion exchange resins, the ions of the dissolved impurities are captured by the ion exchange resin particles and replaced by desirable ions released by the ion exchange particles to the fluid. Therefore, the undesirable ions in the water are exchanged for desirable ions given off by the resin particles.

In a typical process for removing dissolved impurities from water, commonly referred to as a demineralization process, the untreated water containing the dissolved impurities, such as salts or electrolytes, is passed through a bed of cation ion exchange resin. As a result of the ion exchange between the cation ion exchange resin and the water, the salts are changed to corresponding acids. Thereafter, the water is passed through a bed of anion ion exchange resin wherein an ion exchange reaction removes the acids. As a result, there occurs a significant removal of dissolved impurities.

As will be recognized by those skilled in the arts, however, particular and unique problems are presented when the fluid contaminants are radioactive.

The removal of dissolved and undissolved solids from fluids when such dissolved and undissolved solids are radioactive inevitably results in a build-up of radioactive material within the purification apparatus. Passage of undissolved solids through mechanical filter devices causes a build-up of the undissolved solids on the filter structure with the resultant concentration of radioactivity at the filter. Similarly, the removal of dissolved solids by passage through a demineralizer bed of ion exchange resins also results in a build-up of radioactive materials within the demineralizer bed.

This problem of radioactive build-up has been recognized in the art. Accordingly, it is the present practice to permit concentration of radioactive materials to exist up to acceptable limits in a filter apparatus and thereafter to remove the radioactive filter structure as well as any radioactive demineralization resins for transport to a disposal tank. Thereafter, the disposal tank is transported to a burial site and the materials are buried in accordance with accepted regulated procedures. Thus, the radioactive used filters and used ion exchange resins must be handled by personnel and transported from the filter apparatus to a disposal apparatus for burial. Such necessity for handling limits the permissable degrees of radioactive build-up in the filter elements to be disposed of and in the demineralization materials to acceptable radioactive concentration levels. As will be recognized by those skilled in these arts, the upper limit of such levels is approximately 100 Ci.

A disadvantage attendant to the radiation concentration level limitation is that such radiation level occurs prior to the complete usage of the filter apparatus as well as the ion exchange materials. More particularly, it is typically the case that the upper limit of radiation concentration in the demineralize material occurs when the activity of the ion exchange material has been utilized to only approximately 30% of its full ion exchange capability. Similar lack of efficiency has been experienced with respect to mechanical filter elements in the filtration of undissolved radioactive contaminants.

It is clear, therefore, that the filtration and demineralization apparatus and material are not being utilized to their full efficiency thus causing water purification in this manner, where the impurities are radioactive, to be extremely expensive. Furthermore, it will be recognized by those skilled in the art that the handling of radioactive materials by personnel is always a delicate operation and therefore very costly.

A typical example of a situation wherein radioactive impurities are found in water is the miscellaneous drain water occurring in nuclear power electrical generating facilities. In such plants there is a continuous outflow of water from the process equipment. Pumps leak, water is removed for testing purposes, often times equipment such as condensers and pipes may experience leaks.

The normal outflow of waters such as pump leakage, sample waters and the like, must be accommodated on a continuing basis. In nuclear power facilities such impurities are radioactive. Similarly, the abnormal occurrence of waste waters e.g. from condenser leakage, pipe leakage and the like, also presents a radioactive contaminant problem and should be provided for in order to avoid the necessity for plant shut-down other than during ordinary maintenance periods. Such shut-downs, as will be recognized by those skilled in the art, are extremely expensive costing hundreds of thousands of dollars a day.

Known methods and apparatus for purifying such radioactive waste waters involve collection of the waters from around the facility through appropriate drainage into a sump. Thereafter the sump water is pumped into a filtration and/or demineralization apparatus which removes the dissolved and undissolved impurities in order that the water so purified may be returned to the system for reuse or discharged appropriately outside the plant facility.

Such filtration and purification equipment is the type which requires removal of the active demineralization materials and the filter apparatus upon the occurrence of the upper limiting levels of radiation concentration. Thus the known methods and apparatus are both costly by reason of their inefficient use of the purification means as well as limited in the amount of radio-active impurities which may be removed prior to the requirement for shutdown. As discussed briefly above, such shut-down may result in the shut-down of the entire facility.

SUMMARY OF THE INVENTION

It is the object of the present invention, therefore, to provide an apparatus for the removal of radioactive impurities, both dissolved and undissolved, from fluids in such a manner as to obtain full usage of the filtration apparatus and demineralization materials.

Another object of the present invention is to provide an apparatus for the purification of water containing radioactive impurities wherein the necessity for the handling of spent demineralization materials and filter elements is eliminated.

Yet another object of the present invention is to provide an apparatus for the purification of water containing radioactive impurities wherein the apparatus is disposable upon the occurrence of the active capacities of the filter element and demineralization materials being exhausted.

These objects and others not enumerated are achieved by the apparatus of the present invention. One embodiment of apparatus according to the invention may include a fluid tight vessel, inlet and outlet piping extending through the upper wall of the fluid tight vessel, an inlet manifold and dispersion means for depositing fluid to be purified uniformly on a bed of demineralization material, drain piping operating in conjunction with an outlet manifold which is in fluid communication with the outlet pipe for removing purified fluid from the apparatus and filter means for removing undissolved impurities from the fluid to be purified.

The method according to the invention may include the steps of passing contaminated fluid through a bed of material for removing dissolved solids at a rate in the range of 3/10 of a gallon per minute per square foot of demineralization material to 2 gallons per minute per square foot of demineralization material; and passing the fluid through a filter means for removing undissolved solids.

BRIEF DESCRIPTION OF THE DRAWINGS

A more complete understanding of the present invention may be had from the following descriptions thereof particularly when read in the light of the accompanying drawings wherein.

DETAILED DESCRIPTION

Figure 1:
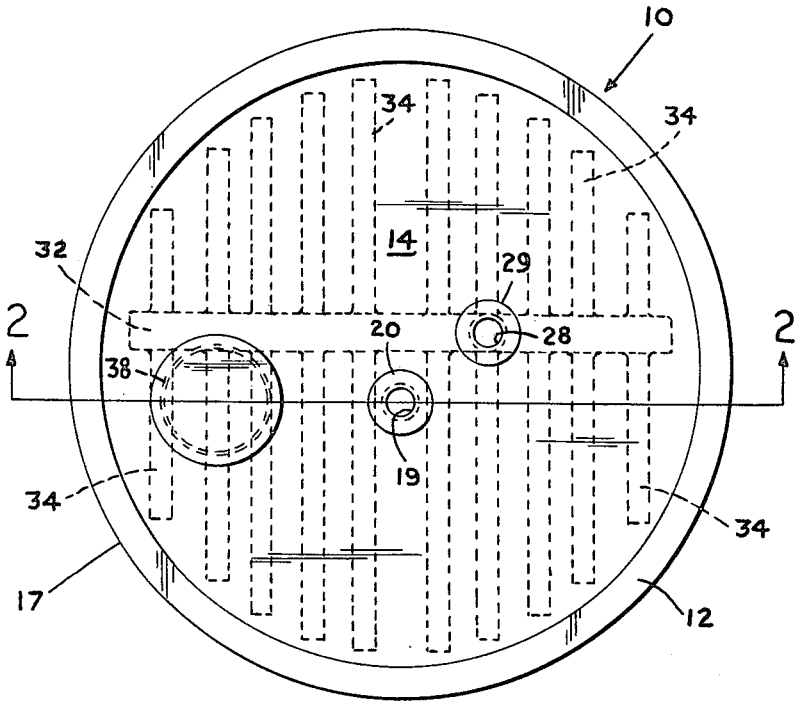
FIG. 1 is a plan view of apparatus structured in accordance with the present invention.

Referring therefore to the drawings and in particular FIGS. 1-4 there is shown a purification apparatus structured in accordance with the present invention and designated generally by the reference numeral 10.

Apparatus 10 comprises a fluid tight vessel 12 having an upper wall section 14 and a lower wall section 15. In the embodiment shown the pressure vessel 12 is generally cylindrical howwever there is no criticality to the shape.

Pressure vessel 12 is contained within a radioactive impervious casing 17 which, in the embodiment shown, is a concrete casing which will be the thickness necessary to preclude the emission of radiation from within vessel 12 upon the complete expenditure of the filter apparatus and demineralizer material all as discussed below. It should also be noted that casing 17 may be of other shielding material such as lead and the like.

Extending vertically centrally axially through an opening formed in the upper wall section of vessel 12 is an effluent pipe 19. Rigidly secured to the upper end of effluent pipe 19 is a flange 20 whereby the effluent pipe may be easily connected and disconnected to effluent piping in the system being served by the filtration apparatus 10.

Figure 3:
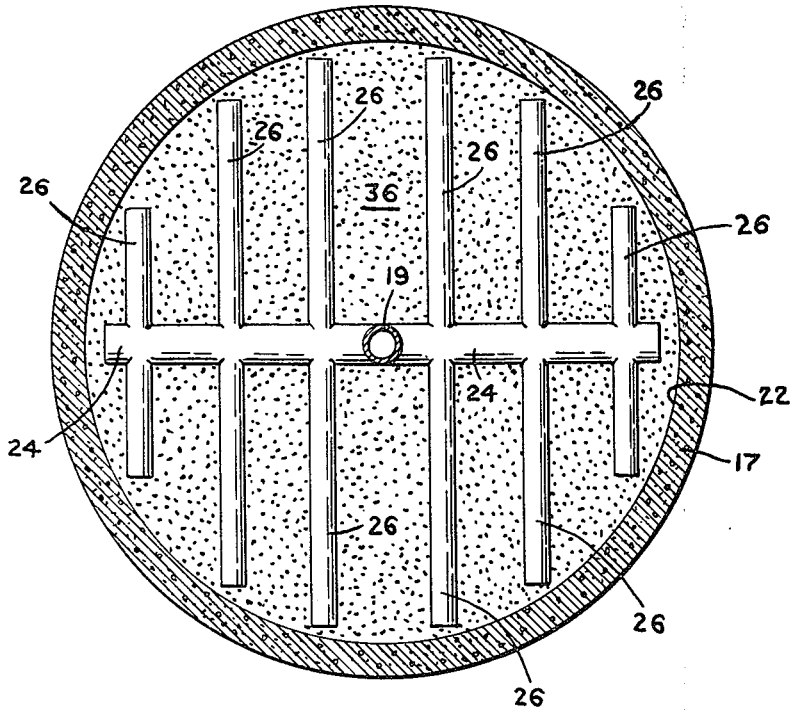
FIG. 3 is a cross-sectional plan view through the plane 3—3 of FIG. 2 showing the drain structure.

Effluent pipe 19 extends vertically downwardly through a chamber 22 defined by the interior of fluid tight pressure vessel 12 and is rigidly secured adjacent lower wall section 15 to an effluent manifold 24. Effluent manifold 24 extends transversely across chamber 22 adjacent lower wall section 15 and defines a collection manifold into which fluid passes from a plurality of drain lines 26. (FIG. 3).

Also extending vertically through an opening in the upper wall section 14 of vessel 12 is an inlet pipe 28. The axis of inlet pipe 28 is parallel to but spaced from the axis of effluent pipe 19.

Rigidly secured to the upper end of inlet pipe 28 is a flange 29, which flange constitutes a mating flange for permitting inlet pipe 28 to be readily connected and disconnected to the piping of a system being served by filtration apparatus 10.

Inlet pipe 28 extends downwardly for a short distance below upper wall section 14 and is rigidly connected to and in fluid communication with an inlet manifold 32. Inlet manifold 32 extends transversely across chamber 22 at a vertical position substantially adjacent upper wall section 14.

Disposed normally to inlet manifold 32 and in fluid communication therewith are a plurality of pipes 34. Pipes 34 are provided with openings in their walls to permit the passage of inlet fluid therethrough into chamber 22. Thus, the group of pipes 34 define dispersion means and are designed to introduce inlet fluid evenly across the transverse area of chamber 22 of vessel 12.

Figure 2:
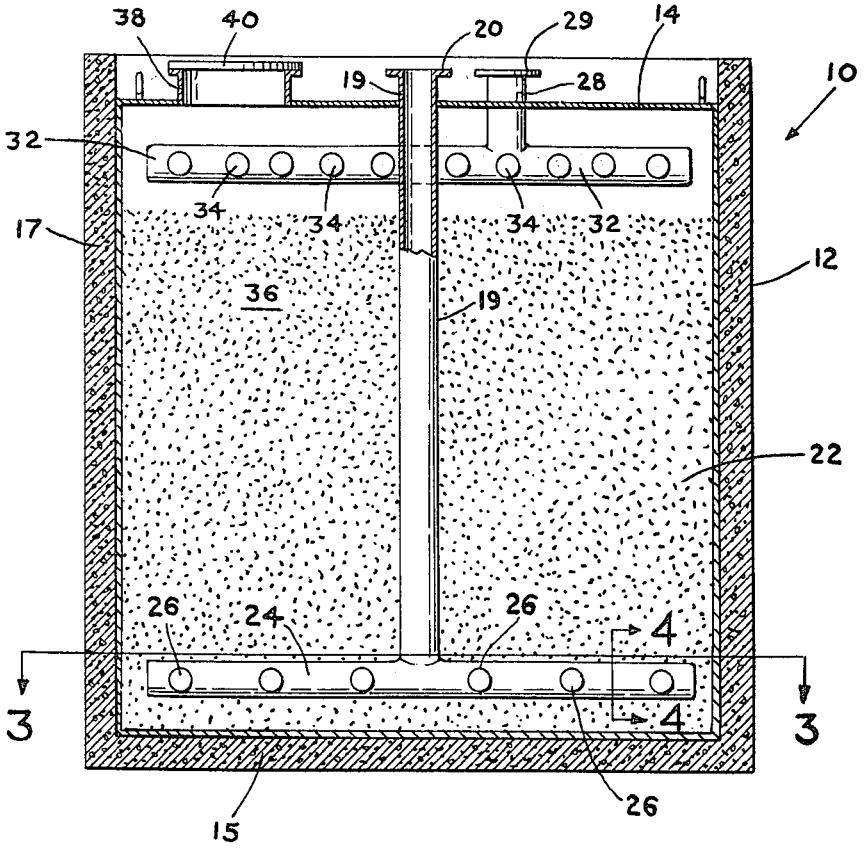
FIG. 2 is a cross-sectional elevational view to the plane 2—2 of FIG. 1.

As best may be seen in FIG. 2, there is provided within chamber 22 a bed 36 of demineralization materials. Such demineralization materials may include cation and anion ion exchange resins of the types generally known in the art and their purpose is for the removal of dissolved solid impurities found in the inlet water passing through apparatus 10 to be purified.

Demineralization material 36 is introduced into chamber 22 through a manhole collar 38 which is received through an opening formed in the upper wall section 14 of vessel 12. Manhole 38 is provided with a cover which may be rigidly secured over the opening defined by manhole 38 to totally close the manhole access as required.

Figure 4:
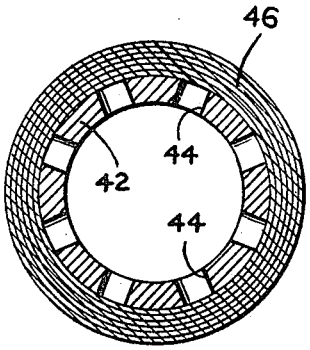
FIG. 4 is a cross-sectional view to the plane 4—4 of FIG. 2 and showing the filter structure for the removal of undissolved impurities.

As best may be seen in FIG. 4, drain lines 26 comprise an internal pipe 42 having a plurality of radially extending openings 44 formed therein. Wrapped around the external surface of pipe 42 is a filtration material 46. Such material may constitute a cotton winding wound around the external surface of the pipe to a thickness of approximately 1/16 to ½ inches depending upon the nature and characteristics of the undissolved solids to be removed from the fluid being treated.

In the operation of filtration apparatus such as apparatus 10 it is has been found that the maintenance of the flow of fluid to be purified through demineralizer bed 36 achieves unexpectedly sound purification when such flow is maintained at a flow rate of between 0.3 and 2.0 gallons per minute per square foot of transverse bed area. Such a flow rate has been found to accommodate purification of the water at efficiencies not heretofore experienced.

More specifically and by way of example an apparatus structured in accordance with FIGS. 1–4 with a chamber diameter of 6 feet was operated for approximately 27 hours processing water contaminated with dissolved and undissolved radioactive wastes. 12,500 gallons of water were processed with the analytical results shown in the table below.

| | Influent Sample | Effluent Sample |
|---|---|---|
| pH | 8.8 | 8.75 |
| Conductivity | 7750 | 5.5 |
| Chloride (ppm) | 50.0 | 0.27 |
| Gross Gamma (cpm/ml) | 2,347, 775 ± 3,065 | 33.5 ± 6.0 |
| | UCi/ml* | |
| Np-239 | 5.308 E-3 | — |
| Tc-99m | 2.612 E-7 | — |
| I-131 | 9.107 E-2 | 1.943 E-6 |
| Ba-140 | 1.697 E-2 | — |
| Cs-134 | 5.686 E-1 | 5.956 E-7 |
| Cs-137 | 1.256 EO | 1.292 E-6 |
| Co-58 | 4.257 E-3 | 1.107 E-6 |
| Cs-136 | 1.263 E-2 | — |
| Mn-54 | 4.364 E-3 | 2.351 E-7 |
| Co-60 | 2.100 E-2 | 4.581 E-6 |
| La-140 | 5.616 E-3 | — |
| | TOTAL 1.986 E0 | 9.754 E-6 |

As evidenced by the foregoing table the clean up efficiency from radioactive material was 99.995% and the decontamination factor was approximately 200,000. The specific activity of the influent waters was 1.986 uCi/ml and that of the effluent water was 9.754 E-6 uCi/ml. Thus on the basis of 12,500 gallons of water processed, approximately 93.96263 Ci of radioactive material entered the filter apparatus and approximately 0.00046 Ci exited. Such efficiencies in such a simple apparatus have been heretofore unknown.

As is discussed above and as will be recognized by those skilled in the arts there are sometimes occurrences of unexpectedly high flows of waste waters which must be handled and purified of radioactivity. Thus for example an unexpected condenser leak may cause the spillage of high volumes of water containing radioactive impurities and may result in the shut-down of an entire plant facility unless the leaking fluids are able to be purified at a rate comparable to the flow rate of the leaks.

Figure 5:
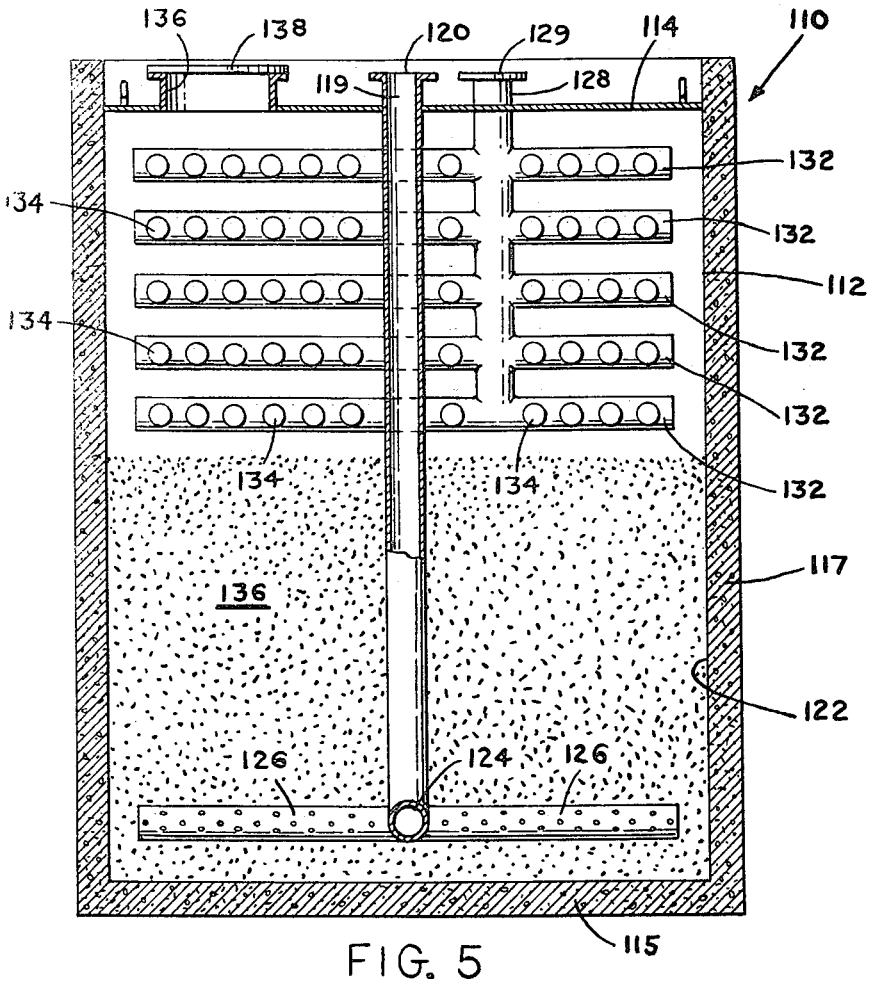
FIG. 5 is a cross-sectional elevational view similar to the view of FIG. 2 but showing a second embodiment of apparatus structured in accordance with the present invention.

An embodiment of apparatus structured in accordance with the present invention and which may provide for a higher flow rate capability than the flow rate of apparatus shown in FIGS. 1–4 is shown in FIG. 5.

More specifically apparatus of FIG. 5 can be seen to comprise a fluid tight vessel 112 received within a casing 117 which may be constructed of a radioactive shielding material as discussed above.

Casing 117 includes an upper wall section 114 and a lower wall section 115.

In the same manner as discussed above with respect to apparatus 10 there is rigidly secured within an opening in upper wall section 114 an effluent pipe 119 on the upper end of which is rigidly secured a piper flange 120. Effluent pipe 119 extends axially vertically downwardly through a chamber 122 defined by vessel 112 to be rigidly secured to and in fluid communication with an effluent manifold 124. Effluent manifold 124 constitutes a collecting manifold for a plurality of drain lines 126 which are disposed transversely across chamber 122 adjacent lower wall section 115. In this regard drain lines 126 are provided with a plurality of openings through which fluid may pass from chamber 122 into drain lines 126 and thereafter through manifold 124 upwardly through effluent pipe 119 and out of apparatus 110 for return to the system or for discharge outside the plant as may be desired.

Disposed parallel to but spaced radially from effluent line 119 is inlet pipe 128. Inlet pipe 128 extends vertically through an opening formed in upper wall section 114 and has rigidly secured to its upper end a flange 129 to permit its connection and disconnection to and from appropriate piping of a system to be served by apparatus 110.

Inlet pipe 128 is rigidly secured to and in fluid communication with a plurality of inlet manifolds 132. Inlet manifolds 132 extends transversely of chamber 122 and are vertically spaced one from another.

Each of inlet manifolds 132 is rigidly secured and in fluid communication with the plurality of dispersion pipes 134 which also extends transversely of chamber 122. Dispersion pipes 134 are provided with a plurality of openings through which inlet fluid passes from the dispersion pipe into chamber 122. Further, in the embodiment of FIG. 5, there is provided around dispersion pipes 134 a filtration medium such as the wound cotton material discussed above with respect to drain lines 26 so that undissolved solids are filtered from the inlet fluid prior to introduction into the chamber 122 of vessel 112.

Disposed within chamber 122 and contained in a space below the inlet manifolds and dispersion pipes is a bed of demineralizing material 136. Such demineralizing material may be introduced within chamber 122 through manhole 136 which may be covered when not open by a suitable manhold cover 138.

In the operation of apparatus 110, inlet fluids are carried into chamber 122 of vessel 112 through inlet pipe 128, manifold 132 and dispersion pipes 134. The undissolved solids are thereby removed by the filtration medium disposed on dispersion pipes 134. Thereafter the inlet fluid containing solids is dispersed across the surface of demineralizer bed 136, passes downwardly therethrough and is removed from chamber 122 through drain line 126, effluent manifold 124 and effluent pipe 119.

As can be seen with respect to both the embodiment of FIGS. 1-4 and the embodiment of FIG. 5, i.e. apparatuses 10 and 110, separation of dissolved and undissolved radioactive solids may be continued without regard to the level of radioactive build-up until such time as the filtration material and demineralization material are expended. This capability, of course, is related to the fact that the entire filtration apparatus is contained within a radiation shielding material. Thus, fully efficient use of both the mechanical and ion exchange filter media may be achieved, which result has not been experienced in prior art approaches to this problem.

In full operation, and with reference to apparatus 10, a filtration structure according to the invention may be brought to a plant to be served and attached by way of flanges 20 and 29 to appropriate piping from the plant's system. Waters may thereafter be purified as discussed above until the mechanical and ion exchange purification media are substantially fully expended.

Once the materials are thus fully expended chamber 22 may be dewatered by attaching inlet pipe 28 to a source of compressed air thus causing the fluid contained within the chamber 22 to be forced downwardly through bed 36 into drain pipes 26 and thereafter out of chamber 22 through effluent manifold 24 and effluent pipe 19. With the vessel thus dewatered, all connections to the plant may be severed, the containers may be sealed and the entire apparatus carted to a waste disposal site for burial in accordance with appropriate regulations. As can be seen from the foregoing the provision of a self-contained disposable filter apparatus permits utilization of both mechanical and ion exchange filtering materials to their optimum usage points. Such utilization is of sufficient economic benefit to justify the approach to this problem by way of a disposable filtration means. Further, the use of a disposable filtration apparatus eliminates the necessity for handling relative highly radioactive waste materials either by personnel or through the use of in-plant piping thus reducing the exposure of personnel to radioactivity and achieving an overall improvement in the safety of the nuclear facility. Thus both operational and economic benefits are achieved.

In applications where dissolved radioactive impurities do not present a problem or present a relatively minor problem, the relative number of inlet dispersion means of the type utilized in FIG. 5 may be provided. Such a structural modification, of course, will increase the volumetric capacity of the unit.

Further, as will be recognized by those skilled in these arts, various modifications and variations to the structure and method of filtration apparatus and its use according to the invention may be made without departing from the spirit and the scope of this invention.

What is claimed is:

1. A disposable filter apparatus for the removal of radioactive dissolved and undissolved solids from a fluid, the filter apparatus comprising:

(a) a fluid tight vessel, said fluid tight vessel including a wall having an upper wall portion and a lower wall portion, said fluid tight vessel defining a chamber containing a bed of demineralization materials for removing said dissolved solids from said fluid;

(b) an inlet pipe extending through a first opening formed in said upper wall portion, the joint defined by the external surface of said inlet pipe and said first opening being closed such as to rigidly secure said inlet pipe to said vessel and to establish a fluid type seal therebetween;

(c) an inlet manifold rigidly secured to said inlet pipe within said chamber, said inlet manifold being in fluid communication with said inlet pipe;

(d) dispersion means rigidly secured to said inlet manifold, said dispersion means for introducing fluid evenly into said bed of materials, said dispersion means being in fluid communication with said inlet manifold to cooperate therewith in accommodating the introduction of contaminated fluid through said inlet pipe and said inlet manifold for dispersion into said bed of material (e) an effluent pipe extending through a second opening formed in said upper wall portion, the joint defined by the external surface of said effluent pipe and said second opening being closed such as to rigidly secure said effluent pipe to said vessel and to establish a fluid tight seal therebetween;

(f) an effluent manifold rigidly secured to said effluent pipe within said chamber, said effluent manifold being in fluid communication with said effluent pipe, and said effluent manifold being positioned within said chamber, adjacent said lower wall portion;

(g) at least one drain line rigidly secured to and in fluid communication with said effluent manifold, each said drain line comprising a pipe having a plurality of openings therethrough to place the interior of said pipe in fluid communication with said bed of demineralization materials;

(h) filter means disposed on at least one of said dispersion means and said drain line for removing said undissolved solids from said fluid; and (i) a shielding means disposed around the outer surface of said vessel, said shielding means capable of precluding the emission of radiation from said vessel to the surrounding environs, and said shielding means defining a casing for said fluid tight vessel whereby, upon exhaustion of said demineralization materials and means for removing undissolved solids from said fluid, the entire structure may be removed to an authorized dumping site and buried thereby precluding the necessity for removing said exhausted, highly radioactive means and materials for removing said dissolved and undissolved solids from said filter apparatus.

2. A disposable filter apparatus as claimed in claim 1 including a third opening formed in said upper wall portion, said third opening for providing access to said chamber from without said vessel, and further including closure means for establishing a fluid tight seal over said third opening.

3. A disposable filter apparatus as claimed in claim 1 wherein said means for removing said undissolved solids from said fluid comprises filter means disposed on said at least one drain line.

4. A disposable filter apparatus as claimed in claim 1 wherein said means for removing said undissolved solids from said fluid comprises filter means disposed on said dispersion means.

5. A disposable filter apparatus according to claim 1 wherein said means for removing said undissolved solids from said fluid comprises a plurality of layers of fabric through which said fluid passes.

6. A disposable filter apparatus according to claim 1 wherein said shielding means extends beyond said upper wall portion of said fluid tight vessel by an amount sufficient to substantially surround said inlet pipe and said effluent pipe.

7. A disposable filter apparatus according to claim 6 wherein said shielding means above said upper wall portion accommodates the reception of a sealing means thereon to fully enclose the fluid tight vessel whereby to prepare the structure for transportation to and burial at an approved waste disposal site.

* * * * *